US005840202A

United States Patent [19]

Walsh

[11] Patent Number: 5,840,202

[45] Date of Patent: Nov. 24, 1998

[54] APPARATUS AND METHOD FOR SHAPING POLISHING PADS

[75] Inventor: Robert J. Walsh, Ballwin, Mo.

[73] Assignee: MEMC Electronic Materials, Inc., St. Peters, Mo.

[21] Appl. No.: 639,185

[22] Filed: Apr. 26, 1996

[51] Int. Cl.[6] ..... H01L 21/00

[52] U.S. Cl. ..... 216/52; 216/84; 216/88; 156/345; 438/691

[58] Field of Search ..... 216/38, 52, 84, 216/88, 90; 156/345 LP; 438/14, 690–692, 748

[56] References Cited

U.S. PATENT DOCUMENTS

| | | | |
|---|---|---|---|
| 4,720,938 | 1/1988 | Gosis | 51/131.1 |
| 5,081,051 | 1/1992 | Mattingly et al. | 437/10 |
| 5,167,667 | 12/1992 | Prigge et al. | 8/137 |
| 5,216,843 | 6/1993 | Breivogel et al. | 51/131.1 |
| 5,384,986 | 1/1995 | Hirose et al. | 451/444 |
| 5,421,768 | 6/1995 | Fujiwara et al. | 451/283 |
| 5,456,627 | 10/1995 | Jackson et al. | 451/11 |
| 5,593,537 | 1/1997 | Cote et al. | 156/345 |
| 5,639,388 | 6/1997 | Kimura et al. | 216/88 X |

OTHER PUBLICATIONS

Written description of an "abrading member" disclosed in application of Harold J. Hileman et al., Ser. No. 08/242,560, allowed Jan. 22, 1996.

*Primary Examiner*—William Powell

*Attorney, Agent, or Firm*—Senniger, Powers, Leavitt & Roedel

[57] ABSTRACT

Apparatus for shaping a polishing pad includes a pad shaping tool and a fixture for holding the pad shaping tool free of fixed connection to the fixture. The pad shaping tool has a pad shaping surface which engages a polishing surface of the polishing pad to shape that surface. The pad shaping surface is sized for engaging the polishing surface across it entire width. The fixture constrains the tool from movement about the center of rotation of the polishing pad and constrains the center of the tool from substantial radial movement with respect to the pad. A method for shaping the polishing pad is also disclosed.

20 Claims, 3 Drawing Sheets

APPARATUS AND METHOD FOR SHAPING POLISHING PADS

BACKGROUND OF THE INVENTION

This invention relates generally to maintenance of polishing pads and more particularly to shaping a polishing pad to maintain flatness of a semiconductor wafer.

The final step in a conventional semiconductor wafer shaping process is a polishing step to produce a highly reflective, damage-free and flat surface on one face of the semiconductor wafer. Polishing usually includes both shaping, which is accomplished by one or more rough polishing steps, and final smoothing, which is accomplished by a finish polishing step. Typically, 95–98% of the stock removal occurs in the rough polishing step(s) which largely determines the final wafer flatness. Semiconductor wafers must be polished particularly flat in preparation for printing circuits on the wafers by an electron beam-lithographic or photolithographic process. Flatness of the wafer surface on which circuits are to be printed is critical in order to maintain resolution of the lines, which can be as thin as 1 micron or less.

Flatness is quantified in part by a Total Thickness Variation measurement (TTV) and Site Total Indicated Reading (STIR). TTV is the difference between the maximum and minimum thicknesses of the wafer and represents an upper limit to wafer flatness. STIR is the sum of the maximum positive and negative deviations of the surface in a small area of the wafer from a reference plane which is parallel to the back surface of the wafer and intersects the front surface at the center of the local site. Total thickness variation in the wafer is a critical indicator of the quality of the polish of the wafer. Preferably, a polished semiconductor wafer will have a TTV of less than one micron and a STIR of less than one-half micron for any 20 mm×20 mm local site.

Polishing of the semiconductor wafer is accomplished by a mechanochemical process in which a rotating polishing pad rubs a polishing slurry against the wafer. In a conventional semiconductor wafer polisher, a surface of the wafer is bonded with wax flat against a polishing block. The wafer and polishing block unit is then held with force by a polishing arm against a polishing surface (i.e., that portion of the upper surface area of the pad which contacts and polishes the wafer) of the rotating polishing pad. The polishing arm may also move the wafers across the polishing pad in an oscillatory fashion as the pad rotates underneath them. The rigid polishing block provides a reference plane with respect to which the polishing surface of the wafer is shaped by polishing to be an essentially parallel, flat plane. As a result, the opposing surfaces of the wafer are parallel to each other.

A typical rough polisher pad is made of polyester fibers impregnated with polyurethane resin. The pad structure remains sufficiently porous after impregnation of the fibers with resin to carry the slurry under the wafer. The pad may have a central opening, such that the pad has an annular shape. The slurry is typically comprised of a colloidal dispersion of ultrafine particles in an aqueous medium together with additives which stabilize the colloid. Other additives may also be used to increase chemical reactivity of the slurry so as to increase polishing rates.

The polishing pad must remain substantially flat in order to produce a wafer having a flat polished surface. However after a number of polishing cycles, the heat and pressure on the polishing pad causes a central annular region of the pad between its annular inner and outer edge margins to become compressed so that it is thinner than the inner and outer edge margins. Thus, the cross sectional profile of the polishing surface of the pad becomes concave. Wafers polished by a pad of concave cross section are shaped with polished surfaces which are more convex than flat. Accordingly, the polishing pad must be re-shaped to lower the inner and outer edge margins of the pad to the level of the central region by abrading away the inner and outer edge margins.

Pad shaping is currently accomplished manually using hand held abrading blocks having a working area much smaller than the polishing surface of the polishing pad. The block is not capable of engaging the polishing surface across its full radial width at any one time. Pad shaping is carried out by moving the block across the pad so that some of the pad underneath the block is abraded away. For instance, the block may be moved along parallel chords across the polishing pad to reduce the concavity of the pad. Occasionally when the pad is too convex in cross section (e.g., when it is a new pad) the block may be moved along diametrical lines passing through the center of the pad to reduce the convexity of the pad.

It has been found that even in the hands of an experienced operator, the existing pad shaping method results in uneven shaping of the pad so that, for example, the radially inner area of the polishing surface of the pad produces a convex wafer while the radially outer area produces a concave wafer. In addition, there is no certainty that the pad will be shaped in the same way every time it is abraded using the existing method, which relies entirely on human judgment. Another problem arises when the polishing surface is less than the entire upper surface area of the pad. The unused areas of the pad tend to be very high relative to the polishing surface and require extensive abrading to bring level with the polishing surface of the pad. It is very difficult to bring down the unused areas without over-abrading the areas of the polishing surface adjacent to the unused areas of the pad.

SUMMARY OF THE INVENTION

Among the several objects and features of the present invention may be noted the provision of apparatus and a method for shaping a polishing pad which uniformly shape the pad over its entire surface; the provision of such apparatus and method which shape the pad in the same way on every application; the provision of such apparatus and method which remove human judgment from the shaping process; the provision of such apparatus and method which are capable of leveling extraordinarily high portions of the pad without over abrading portions of the pad adjacent to the high portions; and the provision of such apparatus and method which are economical and easy to use.

Apparatus of the present invention is used for shaping a polishing pad mounted for rotation about a center of rotation on a polishing machine for polishing and shaping objects. The polishing pad has a polishing surface defined by a radially inner and a radially outer boundary and having a predetermined radial width. The polishing surface has a cross sectional profile between its radially inner and outer boundaries. Generally, the apparatus comprises a pad shaping tool having a center and a pad shaping surface engageable with the polishing surface of the polishing pad for shaping the polishing surface to change the cross sectional profile of the polishing surface from a curved shape to a more flat shape. A fixture is constructed for holding the pad shaping tool free of fixed connection thereto in a position in which the shaping surface of the pad shaping tool engages the polishing pad for shaping the pad as the pad rotates relative to the fixture and pad shaping tool. The fixture constrains the pad shaping tool from rotation about the center of rotation of the polishing pad and constrains the center of the pad shaping tool from substantial radial movement relative to the center of the polishing pad.

A method for polishing semiconductor wafers, using a wafer polishing machine having a rotating polishing pad including a polishing surface as previously defined, generally comprises the step of polishing at least one face of each of a first plurality of semiconductor wafers. The cross sectional profile of the polishing surface is monitored to determine whether the profile of the polishing surface becomes more curved in shape than permitted by a process tolerance amount. If the determined shape of the profile of the polishing surface is more curved than the process tolerance amount, the polishing pad is shaped by placing a pad shaping tool in a fixture such that a pad shaping surface of the tool engages the polishing surface of the polishing pad across the entire radial width of the polishing surface. The polishing pad is rotated while the pad shaping tool is constrained by the fixture from rotation about the center of rotation of the polishing pad whereby the pad shaping tool shapes the polishing surface. Thereafter, at least one face of each of a second plurality of semiconductor wafers is polished.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
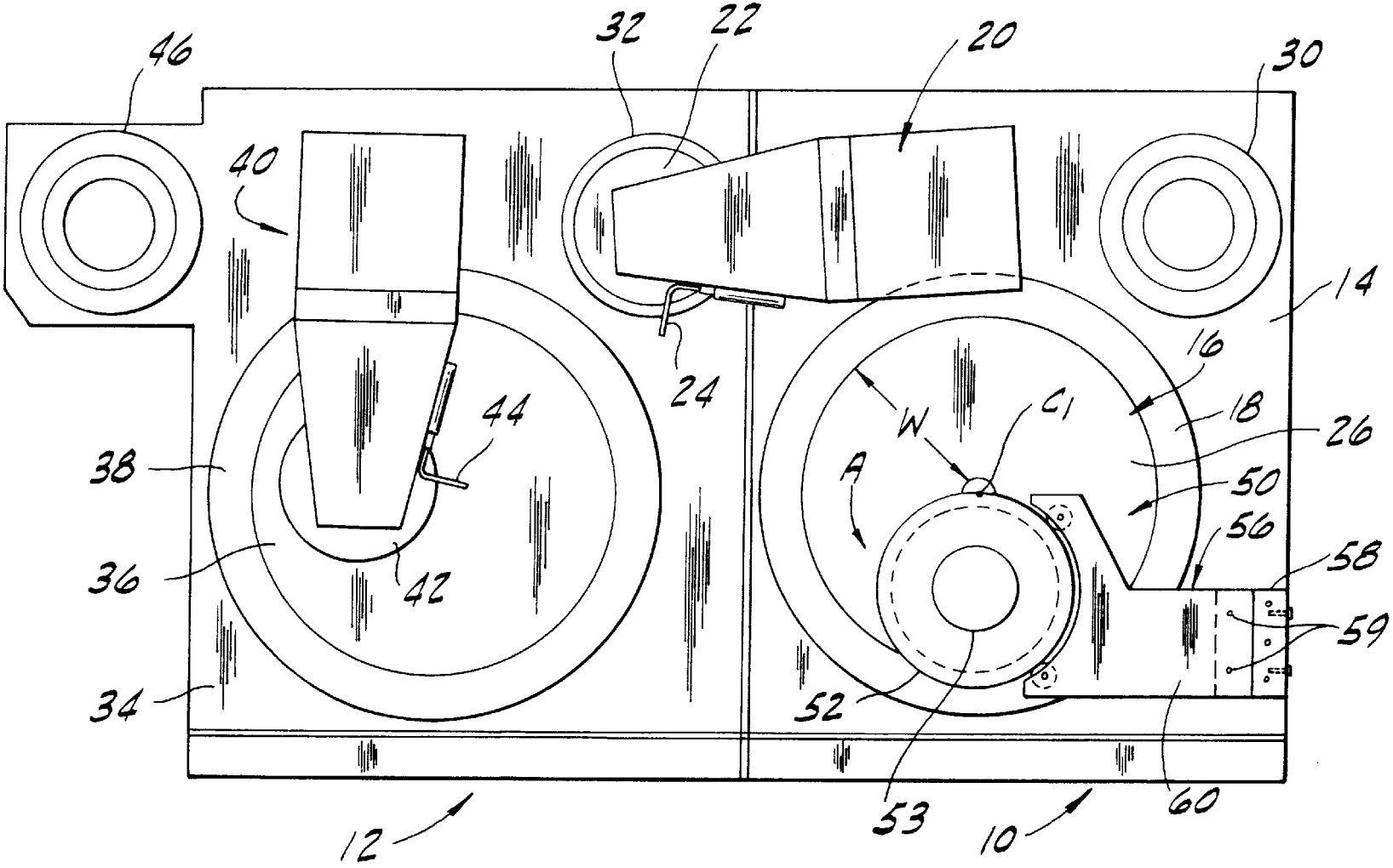
FIG. 1 is a top plan schematic view of a rough polishing machine and a finish polishing machine showing apparatus for shaping a polishing pad of the rough polishing machine.

Referring now to the drawings and in particular to FIG. 1, a rough polishing machine and a finish polishing machine (designated generally by reference numerals 10 and 12, respectively) for polishing of semiconductor wafers are shown. The rough polishing machine 10 includes a table 14 which supports a polishing pad (generally indicated at 16) mounted on a turntable, which is not shown in the drawings because it is covered by the polishing pad. The turntable is capable of rotating the polishing pad 16 with respect to the table 14 about a center of rotation $C_1$. A drip pan 18 underneath the pad 16 catches polishing slurry which drips off of the polishing pad. A polishing arm, generally indicated at 20, includes a chuck 22 for holding a polishing block and wafer mounted thereon (not shown) for polishing one face of the wafer on the polishing pad 16. A tube 24 mounted on the polishing arm 20 is capable of delivering a polishing slurry to the polishing pad 16. The polishing pad 16 is generally annular in shape and, in the preferred embodiment, has a polishing surface 26 corresponding to the entire annular upper surface of the pad. The polishing surface 26 is that portion of the upper surface of the polishing pad 16 which engages the wafer during polishing.

In the preferred embodiment the shape of the polishing pad 16 and the motion of the polishing arm 20 during polishing is such that the wafer moves over the full radial width W of the polishing pad upper surface. The polishing surface in other polishing machines (not shown) is less than the entire upper surface of the polishing pad. Typically, when the polishing surface is smaller than the upper surface of the polishing pad, there are inner and outer peripheral margins which may never contact the wafer during polishing. In that event, the radial width of the polishing surface would be the radial width of the upper surface of the pad less the radial width of the inner and outer peripheral margins. It is to be understood that the polishing surface may be less than the entire upper surface of the pad and still fall within the scope of the present invention.

A first holding station 30 is located in one corner of the table 14 for receiving a polishing block and wafer and holding the block and wafer just prior to polishing by the rough polishing machine 10. The polishing arm 20 is pivotally mounted on the table 14 so that it may swing from a position where the chuck 22 is over the first wafer holding station 30 for picking up a polishing block and wafer, to a position overlying the polishing pad 16 for polishing the wafer, and finally to a position over a second wafer holding station 32. The rough polishing arm 20 is shown in the position over the second wafer holding station 32 in FIG. 1.

The second wafer holding station 32 is on a table 34 of the finish polishing machine 12. Like the rough polishing machine 10, the finish polishing machine 12 includes a polishing pad 36 mounted on a turntable (not shown) for rotation with respect to the table about a center of rotation, and a drip pan 38 underneath the pad. A polishing arm, generally indicated at 40, includes a chuck 42 for holding a polishing block and wafer mounted thereon for polishing on the polishing pad 36. A tube 44 mounted on the polishing arm 40 is capable of delivery a polishing slurry to the polishing pad. The polishing arm 40 is pivotally mounted on the table 34 for swinging from a position in which the chuck 42 is over the second wafer holding station 32 for picking up the polishing block and wafer, to a position overlying the polishing pad 36, and to a position over a wafer exit holding station 46. A primary difference between the rough polishing machine 10 and the finish polishing machine 12 is the composition of their respective polishing pads 16, 36. The rough polishing pad 16 is everywhere of uniform construction and relatively robust for performing its wafer stock removal function. The finish polishing pad 36 is more sponge-like in construction and has upper and lower layers (not shown) of different materials. However, it is to be understood that the precise construction of the pads may be other than described without departing from the scope of the present invention.

Figure 2:
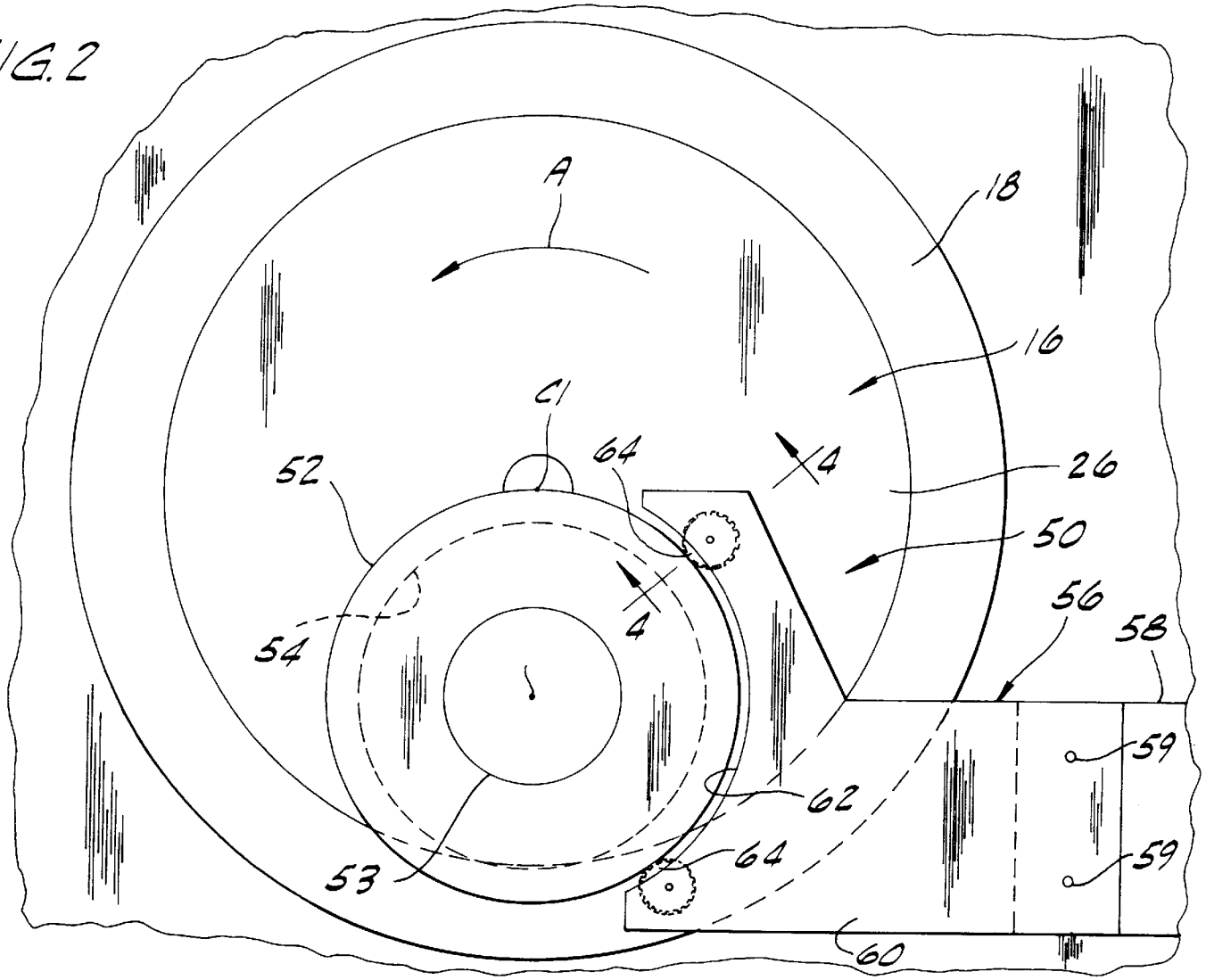
FIG. 2 is an enlarged fragmentary view of the rough polishing machine.
Figure 3:
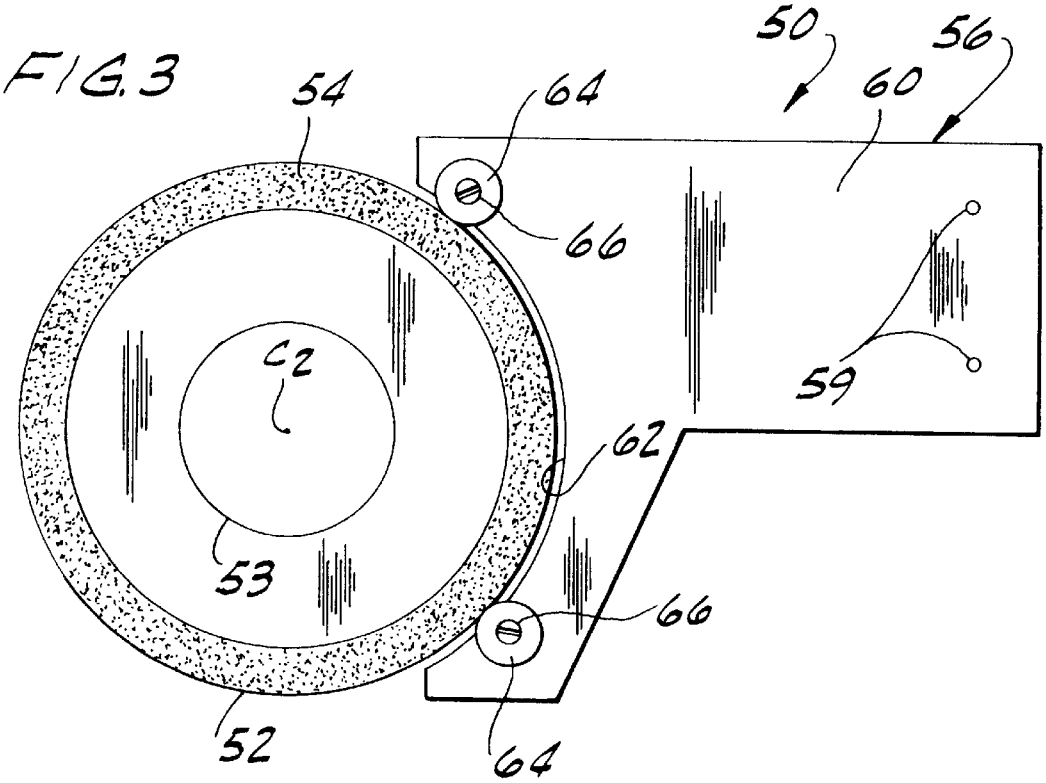
FIG. 3 is a bottom plan view of a pad shaping tool of the apparatus.
Figure 4:
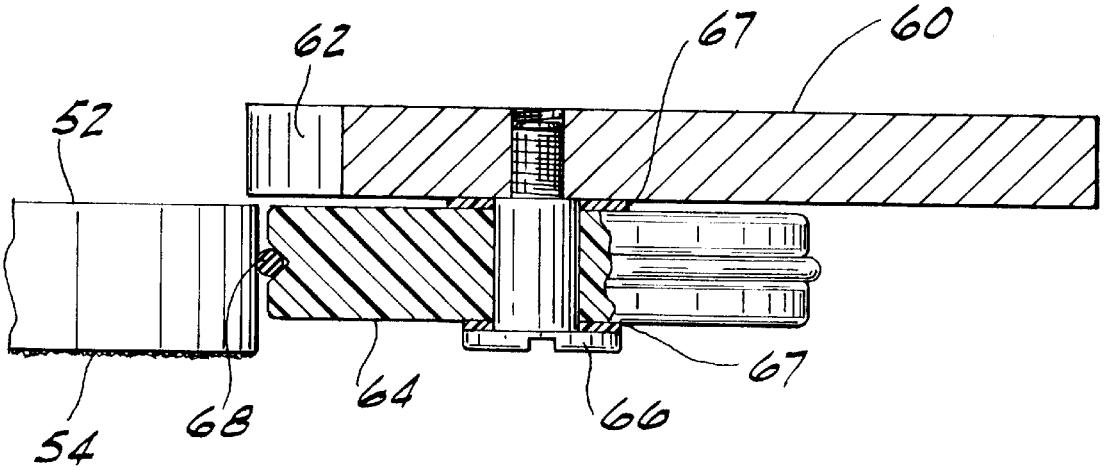
FIG. 4 is a fragmentary sectional view taken as indicated by line 4—4 of FIG. 2.

Referring now also to FIGS. 2 and 3, apparatus indicated generally at 50, for shaping the rough polishing pad 16 is shown to comprise a pad shaping tool 52 in the form of a disk made in the preferred embodiment of aluminum and having a diameter of 304 millimeters and a thickness of 17 millimeters. As may be seen in FIG. 2, the diameter of the pad shaping tool 52 is such that it overlies the entire polishing surface 26 of the polishing pad 16 so that shaping of the entire radial width of the polishing surface occurs at one time. A pad shaping surface 54 of the tool 52 comprises an annular area of abrasive material, such as 50 grit resin bonded $Al_2O_3$ abrasive cloth having an adhesive back for attachment to the bottom of the tool. The abrasive material covers the radially outer 25 millimeters of the bottom surface of the tool 52. It is to be understood that the precise material and dimensions of the pad shaping tool 52 may be other than described for the preferred embodiment and remain within the scope of the present invention. Generally, it is satisfactory to employ a pad shaping tool having a diameter which is about 56 mm larger than the width W of the polishing surface on the polishing pad. In the illustrated embodiment, a raised handle 53 is included on the top of the pad shaping tool 52 for ease in placing the tool on and lifting the tool off of the pad 16.

The pad shaping apparatus further includes a fixture, generally indicated at 56, comprising a bracket 58 for mounting the fixture on the rough polishing machine 10, and an arm 60 extending from the bracket. Correct mounting of the fixture is aided by a pair of studs (not shown) extending up from the bracket 58 which are received in a pair of openings 59 in the arm 60 of the fixture 56. The bracket 58 supports the arm 60 in cantilever fashion above the top of the rough polishing machine 10 so there is no contact between the rough polishing machine (including the pad 16) and the arm. The arm 60 is made in the preferred embodiment of a 6.4 millimeters thick aluminum plate having an arcuate recess 62 in its distal end. Two rollers 64 are mounted by respective shoulder screw connectors 66 on the arm 60 in the recess for rotation relative to the arm. Low friction washers 67 permit the rollers 64 to rotate freely with respect to the connectors 66 and the arm 60. The recess 62 has a radius corresponding to that of the pad shaping tool 52 for receiving a segment of the tool in the recess into engagement with the rollers 64. The rollers each have circumferential grooves in which is received an O-ring 68 disposed for grippingly engaging the tool 52.

The pad shaping tool 52 is at all times free of a fixed connection to the fixture 56. The fixture constrains the tool 52 from rotation about the center of rotation $C_1$ of the polishing pad 16. The center $C_2$ of the pad shaping tool 52 is also constrained from substantial radial motion relative to the center of rotation $C_1$ of the polishing pad 16. However, the rollers permit the pad shaping tool 52 to rotate about its center $C_2$ with respect to the fixture 56.

Figure 5A:
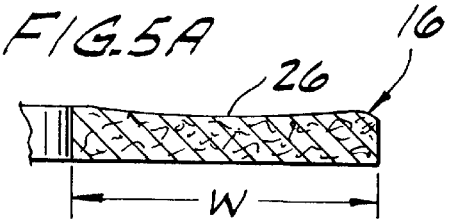
FIG. 5A is a fragmentary, cross sectional view of the polishing pad illustrating a concave profile of a polishing surface of the machine.

In use, the arm 60 of the fixture 56 is initially not mounted on the rough polishing machine 10. However, it is also envisioned that the arm 60 could be pivotally mounted on the rough polishing machine 10 so that it could be swung away from the polishing pad 16 when not in use without complete removal from the polishing machine. It is also envisioned that the tool 52 could be connected to the arm 60 for pivoting with the arm. A first plurality of wafers (not shown) are polished on the rough polishing machine 10 and finish polishing machine 12. The cross sectional profile of the polishing surface 26 of the polishing pad 16 is monitored to determine whether the profile of the polishing surface becomes more concave in shape than permitted by a process tolerance amount. The cross section profile of the pad when it has become concave is illustrated in FIG. 5A. The amount of concavity is exaggerated so that it may be seen on the scale of FIG. 5A. Typically, monitoring is accomplished indirectly by measuring the flatness of the polished face of the wafers polished by the polishing machines 10, 12. For example, the measured total thickness variation (TTV) of the wafer should be less than one micron. Over time, the polished faces of the wafers tend to become more convex, which indicates that the polishing surface 26 is becoming concave. Of course, other ways of monitoring the pad profile may be used without departing from the scope of the present invention.

Once the process tolerance amount has been reached, the rough polishing machine 10 is stopped with its polishing arm 20 in a position over the second wafer holding station 32, as is shown in FIG. 1. The arm 60 is bolted onto the bracket 58 mounted on the rough polishing machine 10 in a position for holding the pad shaping tool 52. The pad shaping tool is placed in the arcuate recess 62 of the arm 60 on top of the polishing pad 16 such that the pad shaping surface 54 extends across the entire radial width W of the polishing surface. The rotation of the polishing pad 16 is indicated by arrow A in FIGS. 1 and 2. The direction of rotation drives the pad shaping tool 52 into the arcuate recess 62 and into engagement with the rollers 64. Thus, the tool 52 is constrained by the fixture 56 from rotating with the polishing pad 16 about its center of rotation $C_1$. Moreover, the center $C_2$ of the pad shaping tool 52 is held from substantial radial movement with respect to the center of rotation $C_1$ of the polishing pad 16. Contact of the tool 52 with the rotary pad 16 causes the tool to rotate about its center $C_2$ relative to the arm 60. The finish polishing machine 12 may continue operation while pad shaping on the rough polishing machine 10 begins. Once finish polishing of the wafer by the finish polishing machine is completed, the arm 40 of the finish polishing machine 12 places the wafer and polishing block on the exit station 46, and halts further operation.

Figure 5B:
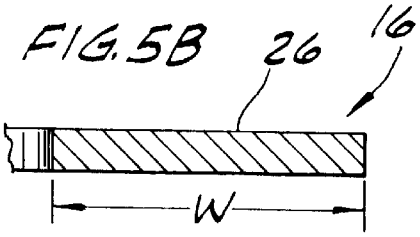
FIG. 5B is a fragmentary, cross sectional view of the polishing pad illustrating a flatter profile of a polishing surface of the machine.

The shape of the pad shaping surface 54 of the pad shaping tool 52 is particularly suited for making the profile of the pad 16 more convex. The pad shaping tool 52 of the preferred embodiment abrades away more of the polishing pad 16 along the radially inner and outer margins, making the profile of the polishing surface 26 of the pad more nearly flat. It is envisioned that the abrasive pad shaping surface 54 on the tool 52 could be made in different configurations for reducing the convexity of the polishing surface 26. Pad shaping continues for a time determined by the operator based on the detected concavity of the pad shaping surface 26. A typical pad shaping time is about ten to thirty seconds, so that this shaping procedure does not seriously disrupt the polishing machine cycles. The flatter cross sectional profile of the polishing surface 26 after shaping is schematically illustrated in FIG. 5B. In practice, the polishing surface 26 may be given a slightly curvex profile (not shown) to permit greater intervals between pad shaping. The pad shaping tool 52 and fixture 56 are removed. A second plurality of wafers are then polished on the newly flattened polishing pad 16 in the same manner as the first plurality of wafers. The flatness of the second plurality of wafers is monitored until it is indicated that the pad 16 must be shaped again.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for shaping a polishing pad mounted for rotation about a center of rotation on a polishing machine for polishing and shaping objects, the polishing pad having a polishing surface defined by a radially inner and a radially outer boundary and having a radial width, the polishing surface having a cross sectional profile between its radially inner and outer boundaries, the apparatus comprising:

a pad shaping tool having a center and a pad shaping surface engageable with the polishing surface of the polishing pad for shaping the polishing surface to change the cross sectional profile of the polishing surface from a curved shape to a flatter shape;

a fixture constructed for holding the pad shaping tool free of fixed connection thereto in a position in which the shaping surface of the pad shaping tool engages the polishing pad for shaping the pad as the pad rotates relative to the fixture and pad shaping tool, the fixture constraining the pad shaping tool from rotation about the center of rotation of the polishing pad and constraining the center of the pad shaping tool from substantial radial movement relative to the center of the polishing pad.

2. Apparatus as set forth in claim 1 wherein the fixture comprises a bracket for mounting the fixture on the polishing machine and an arm extending from the bracket, the arm having a generally arcuate recess in its distal end, the pad shaping tool being received in the recess.

3. Apparatus as set forth in claim 1 wherein the fixture is constructed to hold the pad shaping tool for rotation of the pad shaping tool relative to the fixture.

4. Apparatus as set forth in claim 3 wherein the fixture comprises rollers mounted on the fixture for rotation, the rollers being constructed and arranged for engaging the pad shaping tool to constrain the pad shaping tool from rotation about the center of rotation of the polishing pad while permitting rotation of the polishing pad relative to the fixture.

5. Apparatus as set forth in claim 4 wherein the fixture comprises a bracket for mounting the fixture on the polishing machine and an arm extending from the bracket, the arm having a generally arcuate recess in its distal end, the pad shaping tool being received in the recess.

6. Apparatus as set forth in claim 5 wherein the shaping surface of the pad shaping tool is configured for reducing the height of radially inner and outer portions of the polishing surface of the polishing pad relative to the height of a central portion of the polishing surface.

7. Apparatus as set forth in claim 6 wherein the pad shaping tool and shaping surface are dimensioned such that the shaping surface is engageable with the polishing surface of the polishing pad across its entire radial width.

8. Apparatus as set forth in claim 7 wherein the shaping surface of the pad shaping tool is defined by an annular area of abrasive material on the pad shaping tool.

9. Apparatus for shaping a polishing pad mounted for rotation about a center of rotation on a polishing machine for polishing and shaping objects, the polishing pad having a polishing surface defined by a radially inner and a radially outer boundary and having a radial width, the polishing surface having a cross sectional profile between its radially inner and outer boundaries, the apparatus comprising:

a pad shaping tool having a center and a pad shaping surface engageable with the polishing surface of the polishing pad for shaping the polishing surface, the pad shaping tool being constructed for simultaneously shaping the entire polishing surface of the polishing pad for changing the cross sectional profile of the polishing surface from a curved shape to a flatter shape;

a fixture constructed for holding the pad shaping tool in a position in which the shaping surface of the pad shaping tool engages the polishing pad for shaping the pad as the pad rotates relative to the fixture and pad shaping tool, the fixture constraining the pad shaping tool from rotating about the center of rotation of the polishing pad.

10. Apparatus as set forth in claim 9 wherein the pad shaping tool and shaping surface are dimensioned such that the shaping surface is engageable with the polishing surface of the polishing pad across its entire radial width.

11. Apparatus as set forth in claim 9 wherein the shaping surface of the pad shaping tool is configured for reducing the height of radially inner and outer portions of the polishing surface of the polishing pad relative to the height of a central portion of the polishing surface.

12. Apparatus as set forth in claim 11 wherein the shaping surface of the pad shaping tool is defined by an annular area of abrasive material on the pad shaping tool.

13. Apparatus as set forth in claim 10 wherein the fixture is constructed to hold the pad shaping tool for rotation of the pad shaping tool relative to the fixture.

14. Apparatus as set forth in claim 13 wherein the fixture comprises rollers mounted on the fixture for rotation, the rollers being constructed and arranged for engaging the pad shaping tool to constrain the pad shaping tool from rotation about the center of rotation of the polishing pad while permitting rotation of the polishing pad relative to the fixture.

15. Apparatus as set forth in claim 14 wherein the pad shaping tool is generally disk-shaped, and wherein the fixture comprises a bracket for mounting the fixture on the polishing machine and an arm extending from the bracket, the arm having a generally arcuate recess in its distal end, the pad shaping tool being received in the recess.

16. A method for polishing semiconductor wafers using a wafer polishing machine having a rotating polishing pad including a polishing surface defined by a radially inner and a radially outer boundary and having a radial width, the polishing surface having a cross sectional profile between its radially inner and outer boundaries, the method comprising the steps of:

polishing at least one face of each of a first plurality of semiconductor wafers;

monitoring the cross sectional profile to determine whether the profile of the polishing surface becomes more curved in shape than permitted by a process tolerance amount;

if the determined shape of the profile of the polishing surface is more curved than the process tolerance amount, shaping the polishing pad, said step of shaping the polishing pad comprising the steps of placing a pad shaping tool in a fixture such that a pad shaping surface of the tool engages the polishing surface of the polishing pad across the entire radial width of the polishing surface, rotating the polishing pad and constraining with the fixture the pad shaping tool from rotation about the center of rotation of the polishing pad whereby the pad shaping tool shapes the polishing surface;

polishing at least one face of each of a second plurality of semiconductor wafers.

17. A method as set forth in claim 16 further comprising the step prior to said step of placing the pad shaping tool in the fixture of positioning the fixture on the wafer polishing machine so that the fixture is disposed for holding the pad shaping tool on the polishing pad.

18. A method as set forth in claim 17 further comprising the step prior to said step of polishing at least one face of each of a second plurality of wafers, the step of moving the fixture away from its position for holding the pad shaping tool on the polishing pad.

19. A method as set forth in claim 16 wherein said step of polishing at least one face of a first plurality of wafers comprises the steps of polishing said one face of each of said first plurality of wafers on a polishing pad of a rough wafer polishing machine and polishing said one face of each of said plurality of wafers on a polishing pad of a finish wafer polishing machine, and wherein the step of shaping the polishing pad comprises shaping the polishing pad of the rough polishing machine, said step of shaping occurring during a time which at least partially overlaps the time in which one of the first plurality of wafers is being polished on the finish polishing machine.

20. A method as set forth in claim 16 wherein the step of monitoring the shape of the cross sectional profile of the polishing surface comprises the step of measuring the flatness of the first plurality of wafers to determine whether the shape deviates from being flat by more than a process tolerance amount.

* * * * *